343-700 MS AU 256 EX
3/7/78 OR 4,078,237

United States Patent [19]
Kaloi

[11] 4,078,237
[45] Mar. 7, 1978

[54] OFFSET FED MAGNETIC MICROSTRIP DIPOLE ANTENNA

[75] Inventor: Cyril M. Kaloi, Thousand Oaks, Calif.

[73] Assignee: The United States of America as represented by the Secretary of the Navy, Washington, D.C.

[21] Appl. No.: 740,693

[22] Filed: Nov. 10, 1976

[51] Int. Cl.² ..... H01Q 1/38; H01Q 9/28
[52] U.S. Cl. ..... 343/700 MS; 343/795; 343/830
[58] Field of Search ..... 343/700 MS, 705, 829, 343/846; 343/700 MS

[56] References Cited

U.S. PATENT DOCUMENTS

| | | | |
|---|---|---|---|
| 3,475,755 | 10/1969 | Bassen et al. | 343/705 |
| 3,478,362 | 11/1969 | Ricardi et al. | 343/700 MS |
| 3,971,032 | 7/1976 | Munson et al. | 343/700 MS |

FOREIGN PATENT DOCUMENTS

| | | | |
|---|---|---|---|
| 1,050,583 | 1/1954 | France | 343/705 |

*Primary Examiner*—Alfred E. Smith
*Assistant Examiner*—Harry E. Barlow
*Attorney, Agent, or Firm*—Richard S. Sciascia; Joseph M. St.Amand

[57] ABSTRACT

An offset FED magnetic microstrip dipole antenna consisting of a thin electrically conducting, element formed on one surface of a dielectric substrate, the ground plane being on the opposite surface with the radiating element shorted to the ground plane. The length of the element determines the resonant frequency. The feed point is located along one edge of the antenna length and the input impedance can be varied by moving the feed point along the edge of the antenna to obtain optimum match for the resonant mode without affecting the radiation pattern. The antenna bandwidth increases with the width of the element and spacing between the element and ground plane.

10 Claims, 9 Drawing Figures

OFFSET FED MAGNETIC MICROSTRIP DIPOLE ANTENNA

CROSS-REFERENCES TO RELATED APPLICATIONS

This invention is related to U.S. Pat. No. 3,978,488 issued Aug. 31, 1976 for OFFSET FED ELECTRIC MICROSTRIP DIPOLE ANTENNA, by Cyril M. Kaloi and commonly assigned.

This invention is also related to copending U.S. Pat. Applications:

| | |
|---|---|
| Serial No. 740,695 | for ASYMMETRICALLY FED MAGNETIC MICROSTRIP DIPOLE ANTENNA; |
| Serial No. 740,697 | for NOTCH FED MAGNETIC MICROSTRIP DIPOLE ANTENNA; |
| Serial No. 740,691 | for COUPLED FED MAGNETIC MICROSTRIP DIPOLE ANTENNA; |
| Serial No. 740,694 | for ELECTRIC MONOMICROSTRIP DIPOLE ANTENNAS; |
| Serial No. 740,690 | for TWIN ELECTRIC MICROSTRIP DIPOLE ANTENNAS; |
| Serial No. 740,696 | for NOTCHED/DIAGONALLY FED ELECTRIC MICROSTRIP DIPOLE ANTENNA; and |
| Serial No. 740,692 | for CIRCULARLY POLARIZED ELECTRIC MICROSTRIP ANTENNAS; |

all filed together herewith on Nov. 10, 1976, by Cyril M. Kaloi, and commonly assigned.

The present invention is related to antennas and more particularly to microstrip type antennas, especially low profile microstrip antennas that can also be arrayed to provide near isotropic radiation patterns.

SUMMARY OF THE INVENTION

The present antenna is one of a family of new microstrip antennas. The specific type of microstrip antenna described herein is the "offset fed magnetic microstrip dipole." Reference is made to the "magnetic microstrip dipole" instead of simply the "microstrip dipole" to differentiate between two basic types; one being the magnetic microstrip type, and the other being the electric microstrip type. The offset fed magnetic microstrip dipole antenna belongs to the magnetic microstrip type antenna. The magnetic microstrip antenna consists essentially of a conducting strip called the radiating element and a conducting ground plane separated by a dielectric substrate, with the radiating element having one end shorted to the ground plane. The shorting of the radiating element to the ground plane can be accomplished by electroplating through a series of holes or by means of rivets. Shorting the element to the ground plane also allows a smaller antenna to be constructed for the same resonant frequency as would be available from a larger electric microstrip antenna. The length of the radiating element is approximately one-fourth wavelength. The element width can be varied depending on the desired electrical characteristics. The conducting ground plane is usually greater in length and width than the radiating element.

The magnetic microstrip antenna's physical properties are somewhat similar to those of the electric microstrip antenna, with the exceptions that the radiating element is only one-half the size of the electric microstrip antenna (i.e., approximately one-fourth wavelength in length whereas the electric microstrip antenna is one-half wavelength in length) and that the radiating element has one end shorted to ground in the magnetic microstrip antenna. However, the electrical characteristics of the magnetic microstrip antenna are quite different from the electric microstrip antenna, as will be hereinafter shown.

This antenna can be arrayed with interconnecting microstrip feedlines as part of the element. Therefore, the antenna element and the feedlines can be photoetched simultaneously. Using this technique, only one coaxial-to-microstrip adapter is required to interconnect an array of these antennas with a transmitter or receiver.

The thickness of the dielectric substrate in both the electric and magnetic microstrip antenna should be much less than one-fourth the wavelength. For thickness approaching one-fourth the wavelength, the antenna radiates in a monopole mode in addition to radiating in a microstrip mode.

The antenna as hereinafter described can be used in missiles, aircraft and other type applications where a low physical profile antenna is desired. The present type of antenna element provides completely different radiation patterns and can be arrayed to provide near isotropic radiation patterns for telemetry, radar, beacons, tracking, etc. By arraying the present antenna with several elements, more flexibility in forming radiation patterns is permitted. In addition the antenna can be designed for any desired frequency within a limited bandwidth, preferably below 25 GHz, since the antenna will tend to operate in a hybrid mode (i.e., microstrip monopole mode) above 25 GHz for most stripline materials commonly used. For clad materials thinner than 0.031 inch, higher frequencies can be used and still maintain the microstrip mode. The design technique used for this antenna provides an antenna with ruggedness, simplicity, low cost, a low physical profile, and conformal arraying capability about the body of a missile or vehicle where used including irregular surfaces while giving excellent radiation coverage. The antenna can be arrayed over an exterior surface without protruding, and be thin enough not to affect the airfoil or body design of the vehicle. The thickness of the present antenna can be held to an extreme minimum depending upon the bandwidth requirement; antennas as thin as 0.005 inch for frequencies above 1,000 MHz have been successfully produced. Due to its conformability, the antenna can be applied radially as a wrap around band to a missile body without the need for drilling or injuring the body and without interfering with the aerodynamic design of the missile. In the present type antenna, the antenna element is grounded to the ground plane, and the antenna can be easily matched to most practical impedances by varying the location of the feed point along one edge of the element.

Advantages of an antenna of this type over other similar appearing types of microstrip antennas is that the present antenna can be fed very easily from the ground plane side and has a slightly wider bandwidth for the same form factor.

The offset fed magnetic microstrip dipole antenna consists of a thin, electrically-conducting, rectangular-shaped element formed on the surface of a dielectric substrate; the ground plane is on the opposite surface of the dielectric substrate and the microstrip antenna element can be fed at the feed point from a coaxial-to-microstrip adapter, with the center pin of the adapter extending through the ground plane and dielectric substrate to the antenna element. The length of the antenna element determines the resonant frequency. The feed point is located along one edge of the antenna length. While the input impedance will vary as the feed point is moved along the edge parallel to the centerline of the length in either direction, the radiation pattern will not be affected by moving the feed point. The antenna bandwidth increases with the width of the element and the spacing (i.e., thickness of dielectric) between the ground plane and the element; the spacing has a somewhat greater effect on the bandwidth than the element width. The minimum width of the radiating element is determined by the equivalent internal internal resistance of the conductor plus any loss due to the dielectric, as discussed in aforementioned U.S. Pat. No. 3,978,488. The radiation pattern changes very little within the bandwidth of operation.

Design equations sufficiently accurate to specify a few of the design properties of the offset fed magnetic dipole antenna are discussed later. These design properties are the input impedance, radiation resistance, the bandwidth, the efficiency and the antenna element dimensions as a function of the frequency. Calculations have been made using such equations, and typical offset fed magnetic microstrip dipole antennas have been built using the calculated results, and actual measurements of the fields, gain and polarization have been made.

DESCRIPTION AND OPERATION

Figure 1:
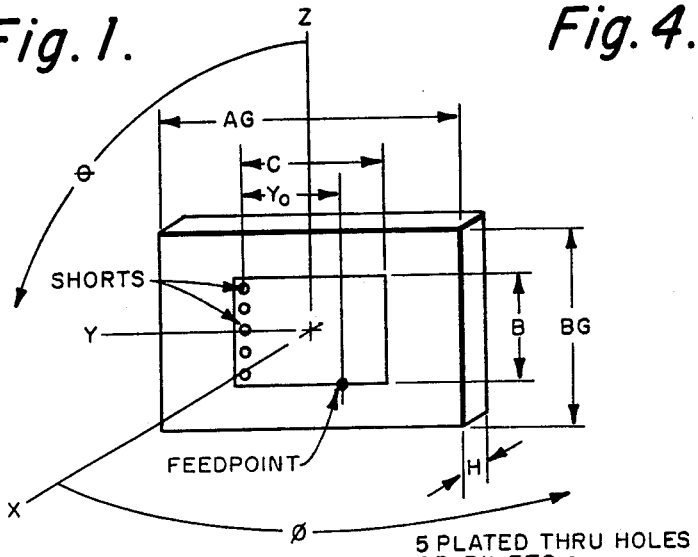
FIG. 1 illustrates the alignment coordinate system used for the offset fed magnetic microstrip dipole antenna.

The coordinate system used and the alignment of the antenna element within this coordinate system are shown in FIG. 1. The coordinate system is in accordance with the IRIG (Inter-Range Instrumentation Group) Standards and the alignment of the antenna element was made to coincide with the actual antenna patterns that will be shown later. The B dimension is the width of the antenna element. The C dimension is the effective length of the antenna element measured from the short to the opposite end. The C dimension lies along the Y axis in the XY Plane and the B dimension lies along the Z axis in the XZ Plane as shown in FIG. 1. The H dimension is the height of the antenna element above the ground plane and also the thickness of the dielectric. The AG dimension and the BG dimension are the length and the width of the ground plane, respectively. The $Y_o$ dimension is the location of the feed point measured from the grounding electroplated holes or rivets, i.e., short. The angles $\theta$ and $\phi$ are measured per IRIG Standards. The above parameters are measured in inches and degrees.

The length C of the antenna radiating element is that dimension measured from the short (i.e., the center of the rivets or plated-thru holes) to the opposite end of the element, as shown in FIG. 1. The number and spacing of the shorting rivets or plated-thru holes can be varied without affecting the proper operation of the antenna. The more shorts along the short line, however, the greater will be the accuracy of the equation for the length, C. More or less shorts than shown in the figures of drawing can be used; the number shown in the drawings, however, operate very satisfactorily.

The grounding rivets or plated-thru holes operate effectively for shorting the radiating element to the ground plane, as shown in the drawings. The size of the rivet or plated-thru holes can be varied. However, as the diameter of the rivet or plated-thru hole is increased, this will shorten the effective length of the radiating element, thereby increasing the center frequency. Conversely, decreasing the diameter will increase the effective length of the radiating element and thereby decrease the center frequency of the antenna. The rivets or plated-thru holes are normally close to the edge of the shorted end of the antenna element. As long as the distance between the rivet or plated-thru hole and the shorted end of the element strip is a very small fraction of the wavelength, the operation of the antenna will not be affected.

Figure 2:
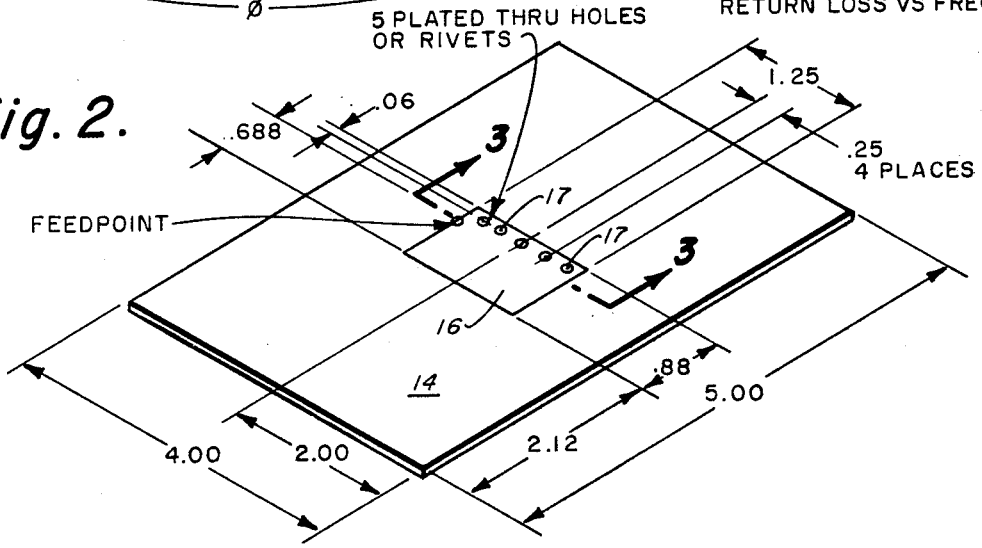
FIG. 2 is an isometric planar view of a typical rectangular offset fed, electric microstrip dipole antenna.
Figure 3:
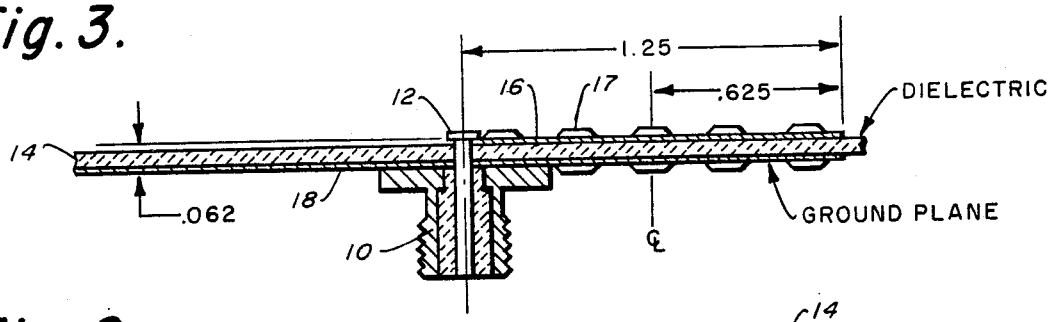
FIG. 3 is a cross-sectional view taken along section line 3—3 of FIG. 2.

FIGS. 2 and 3 show a typical offset fed magnetic microstrip dipole antenna of the present invention. The element can be fed on either edge along the length of the element. If the element width (i.e., B dimension) is less than approximately one-quarter wavelength, the antenna will oscillate in only one resonant mode. For this mode of oscillation, the current distribution is cosinusoidal along the length and constant along the width. If the element width is greater than one-half wavelength but less than the element length, the antenna will oscillate in both a resonant mode along the length and also a non-resonant mode along the width. If the width is less than the length, the amount of signal coupled to the non-resonant mode is minimal due to 1) the incoming signal being out of phase with the oscillating signal, therefore having destructive interference between the oscillating signal and the incoming signal; and 2) the mismatch between the signal source and the input impedance to the non-resonant mode. Most of the energy is coupled into the resonant mode, since at resonance the incoming signal is in phase with the oscillating signal and the source resistance is matched to the resonant mode. An optimum match is obtained for the resonant mode by varying the location of the feed point along the edge.

Figure 4:
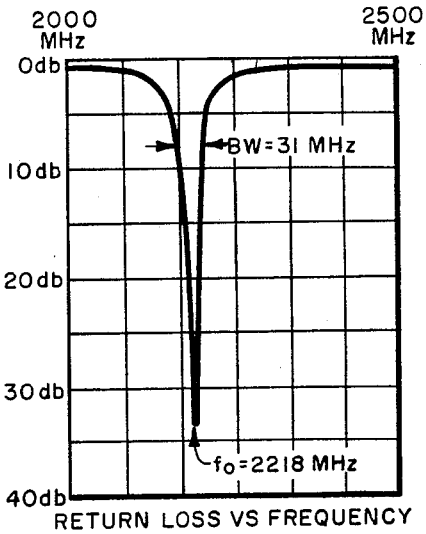
FIG. 4 is a plot showing the return loss versus frequency for an offset fed magnetic microstrip antenna element having the dimensions shown in FIGS. 2 and 3.

FIG. 4 shows a plot of return loss versus frequency, which is an indication of the match for the antenna configuration having dimensions as shown in FIGS. 2 and 3.

Figure 5:
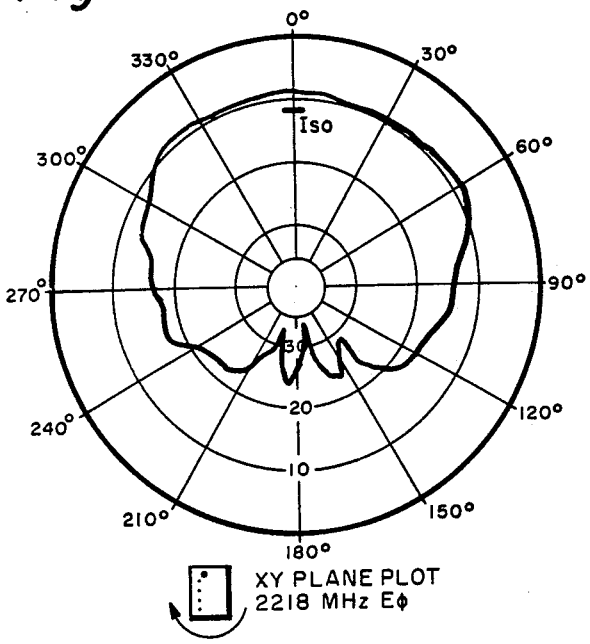
FIG. 5 shows the antenna radiation pattern (XY Plane plot) for the antenna element shown in FIGS. 2 and 3.
Figure 6:
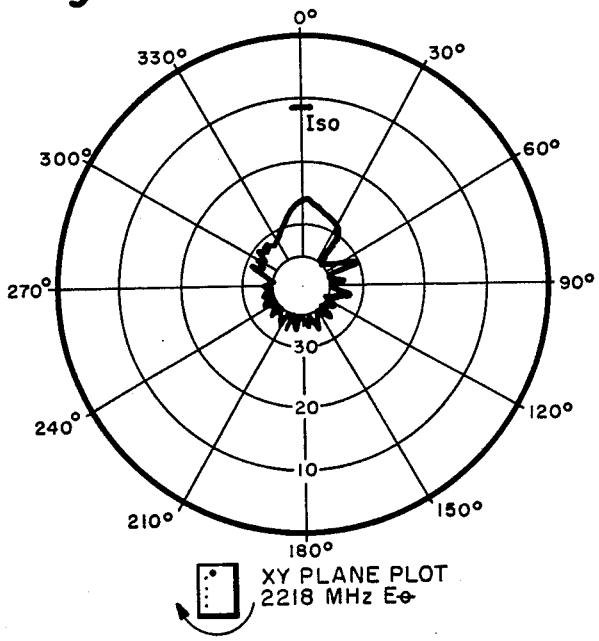
FIG. 6 shows the corresponding cross-polarization plot for the XY Plane, for the antenna of FIGS. 2 and 3.
Figure 7:
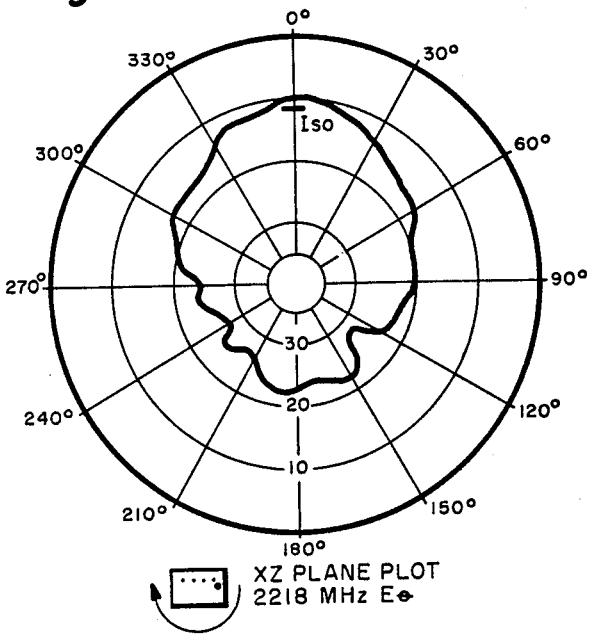
FIG. 7 shows the antenna radiation pattern (XZ Plane plot) for the antenna element shown in FIGS. 2 and 3.
Figure 8:
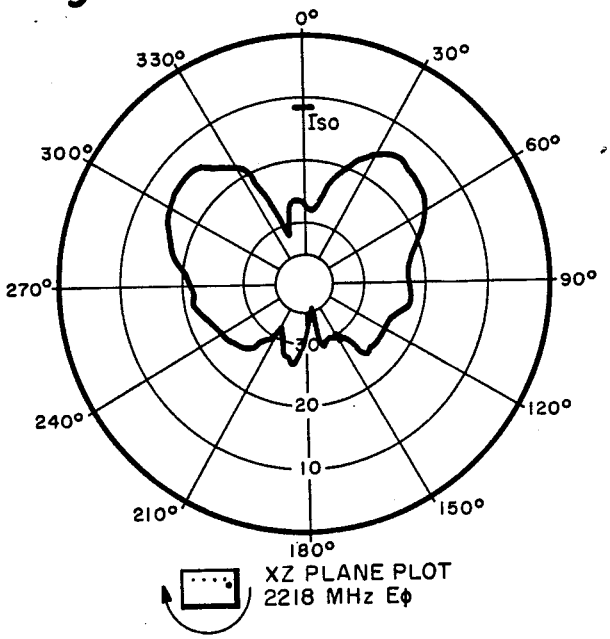
FIG. 8 shows the corresponding cross-polarization plot for the XZ Plane for the antenna of FIGS. 2 and 3.

FIGS. 5 and 7 show radiation pattern plots for the XY Plane and the XZ Plane, respectively, for the antenna configuration of FIGS. 2 and 3. FIGS. 6 and 8 show corresponding cross-polarization plots for the XY Plane and the XZ Plane respectively. Cross polarization radiations due to the non-resonant mode of oscillation shown in FIG. 6 is more than 18 db below the radiation due to the resonant mode, as shown in FIG. 8. The resultant electric field due to the dual mode of oscillation tends to rotate away from the axis along the length.

However, for the configurations shown in FIGS. 2 and 3 the rotation is very slight. The dual mode of oscillation is not detrimental as far as the performance of the antenna is concerned.

The typical antenna illustrated with the dimensions given in inches is shown in FIGS. 2 and 3, is by way of example, and the curves shown in the later figures are for the typical antenna illustrated. The antenna is fed from a coaxial-to-microstrip adapter 10, with the center pin 12 of the adapter extending through the dielectric substrate 14 and connected to the feed point on the edge of microstrip element 16. The element is shorted by means of rivets or plated-thru holes 17 to the ground plane 18. The microstrip antenna can be fed with most of the different types of coaxial-to-microstrip launchers presently available. Dielectric substrate 14 separates the element 16 from the ground plane 18 electrically.

The copper losses in the clad material determine how narrow the element can be made. The length of the element determines the resonant frequency of the antenna, about which more will be mentioned later. It is preferred that both the length and the width of the ground plane extend at least one wavelength (λ) in dimension beyond each edge of the antenna element to minimize backlobe radiation.

The input impedance is affected by the width of the element, the height of the dielectric, the dielectric constant, radiation resistance, etc. The resonating mode of current oscillation contributes to five oscillating dipole moments, along the four edges and broadside to the element The higher order modes of current oscillation contributes only to the oscillating moments on the two sides of the elements along the length.

Figure 9:
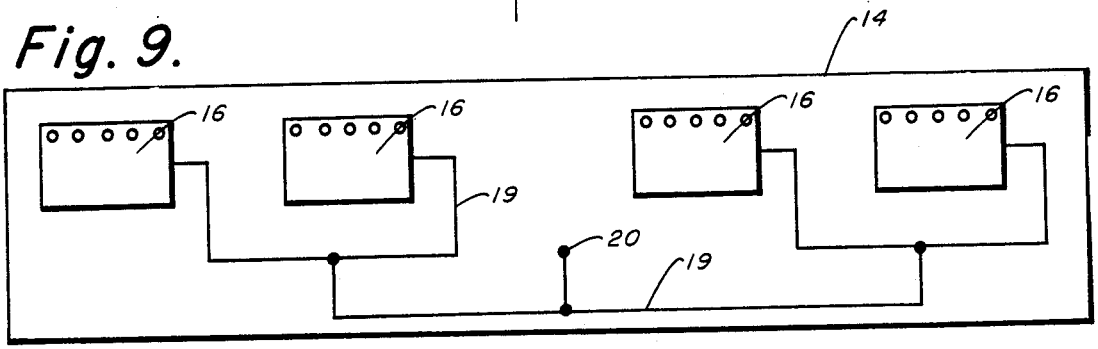
FIG. 9 shows a typical arraying configuration using several antenna elements.

A plurality of microstrip antenna elements 16 can be arrayed on a single dielectric substrate 14 using microstrip transmission lines or network 19, as diagrammatically illustrated in FIG. 9, using only one coaxial-to-microstrip adapter connection at 20.

DESIGN EQUATIONS

To a system designer, the properties of an antenna most often required are the input impedance, gain, bandwidth, efficiency, polarization, and radiation pattern. The antenna designer needs to know the above-mentioned properties and also the antenna element dimension as a function of frequency. The exact equations for the offset fed microstrip dipole are somewhat more complicated if second order effects due to the non-resonant mode of oscillation are considered. For approximate design equations, one can assume the non-resonant mode of oscillation to be minimum and with this assumption, the following applies:

Antenna Element Dimension

The equation for determining the length, C, of the antenna element is given by $$C = \frac{\left[1.18 \times 10^{10} - F \times 4 \times H \times \sqrt{\epsilon}\right]}{\left[4 \times F \times \sqrt{1 + 0.61 \times (\epsilon - 1) \times (B/H)^{0.1155}}\right]}$$

where $x$ = indicates multiplication

F = center frequency (Hz)

$\epsilon$ = the dielectric constant of the substrate (no units).

In most applications, B, F, H and $\epsilon$ are usually given. However, it is sometimes desirable to specify B as a function of C as in a square element. As seen from this equation, a closed form solution is not possible for the square element. However, numerical solution can be accomplished by using Newton's Method of successive approximation (see U.S. National Bureau of Standards, Handbook Mathematical Functions, Applied Mathematics Series 55, Washington, D.C., GPO, Nov 1964) for solving the equation. The equation for C is obtained by fitting curves to Sobol's equation (Sobol, H., "Extending IC Technology to Microwave Equipment," ELECTRONICS, Vol. 40, No. 6, (20 Mar 1967), pp. 112–124). The modification was needed to account for end effects when the microstrip transmission line is used as an antenna element. Sobol obtained his equation by fitting curves to Wheeler's conformal mapping analysis (Wheeler, H. "Transmission Line Properties of Parallel Strips Separated by a Dielectric Sheet," IEEE TRANSACTIONS, Microwave Theory Technique, Vol. MTT-13, No. 2, Mar 1965, pp. 172–185).

As shown in FIG. 1, the length C of the antenna radiating element is that dimension measured from the short (i.e., the center of the rivets or plated-thru holes) to the opposite end of the element. The number and spacing of the shorting rivets or plated-thru holes can be varied without affecting the proper operation of the antenna. The more shorts along the short line, however, the greater will be the accuracy of the equation for the length, C. More or less shorts than shown in the figures of drawing can be used; the number shown in the drawings, however, operate very satisfactorily. The rivets and plated-thru holes are similar to those used in printed circuits.

The offset fed magnetic microstrip dipole antenna can be made as narrow as the internal resistance losses allow it to be, and yet allow it to be fed at the optimum feed point. This permits very narrow strip antennas when needed.

Derivation of design equations mentioned earlier, requires having an expression for the $E_\theta^2$ and $E_\phi^2$ power fields. The $E_\phi$ field and the $E_\phi$ field for the "Offset Fed Magnetic Microstrip Dipole Antenna" are very complex. The reasons are that five modes of oscillating dipole moment alignment occur on the element. These oscillating dipole moments occur between the edges of the element and the ground plane along the four edges, in addition to the oscillating dipole moments broadside to the element. A single current oscillation mode in the cavity between the element and ground plane contributes to the five dipole moments of oscillation.

It has been shown that if only one oscillating "cavity current" mode takes place, as in this antenna, the radiation resistance for the element may be derived by assuming that all the power occurs in one oscillating dipole moment mode, since the radiation resistance, $R_a$, is given by the total radiated power, W, divided by the effective oscillating cavity current $I_{eff}$. Although this technique does not give an accurate calculated shape of the radiation pattern, the gain or the polarization of the antenna element, it does provide the total power radiated. The total power radiated is all that is required to determine the other antenna properties such as input impedance, bandwidth and efficiency. The exact fields, antenna gain, and polarization can be obtained by actual measurements, as shown in FIGS. 5, 6, 7 and 8, and therefore equations for these properties are not absolutely required. However, if it is desired to obtain equations for the fields, all five oscillating dipole moments mode must be taken into consideration.

If one assumes that all the power occurs in the "dipole moment mode" broadside to the element, by virtue of the image principle one can proceed to derive the equations of radiation resistance, input impedance, bandwidth and efficiency in the same manner as was derived for "Offset Fed Electric Microstrip Dipole Antenna" in aforementioned U.S. Pat. No. 3,978,488. The antenna element length, C, as a function of frequency, f, was derived earlier. However, upon invoking the image principle, the length for the element used in computations for the offset fed magnetic microstrip antennas must be double.

By letting $$A = 2C$$

where A is the length of the element plus the image length, and having calculated the total power radiated, the properties mentioned above can be computed for this antenna. Equations for the radiation resistance, input impedance, efficiency, and bandwidth given in aforementioned U.S. Pat. No. 3,978,488 can be used to provide reasonably accurate results for the offset fed magnetic microstrip dipole antenna, keeping in mind that $A = 2C$ in these equations.

Typical antennas have been built using the aforementioned equations and the calculated results are in good agreement with test results.

The magnetic microstrip antennas involve major differences in electrical characteristics when compared to the electric microstrip antennas. This is particularly true as to radiation pattern configurations. Further, the magnetic microstrip antennas are susceptible to complex polarization, which are desirable under certain circumstances.

These complex polarization patterns give a half-donut configuration in the YZ plane completely around the antenna. In addition, in the XY plane, there is provided a pattern broadside to the element (i.e., above the ground plane).

The offset fed magnetic microstrip dipole antenna can easily be arrayed with microstrip transmission line, and fed from a single coaxial-to-microstrip adapter at one connection point.

Obviously many modifications and variations of the present invention are possible in light of the above teachings. It is therefore to be understood that within the scope of the appended claims, the invention may be practiced otherwise than as specifically described.

What is claimed is:

1. An offset fed magnetic microstrip dipole antenna having low physical profile and conformal arraying capability, comprising:

a. a thin ground plane conductor;

b. a thin substantially rectangular radiating element spaced from said ground plane;

c. said radiating element being electrically separated from said ground plane by a dielectric substrate;

d. said radiating element being shorted to the ground plane at one end of the length thereof;

e. said radiating element having a feed point located along an edge of the length thereof;

f. the length and width of said radiating element and the spacing between the radiating element and the ground plane all being factors determining the resonant frequency of said antenna;

g. the antenna input impedance being variable to match most practical impedances as said feed point is moved along said edge of the length of said radiating element without affecting the antenna radiation pattern;

h. the antenna bandwidth being variable with the width of the radiating element and the spacing between said radiating element and said ground plane, and spacing between the radiating element and the ground plane having somewhat greater effect on the bandwidth than the radiating element width;

i. said radiating element oscillating in five oscillating dipole moments, one at each of the four edges of said radiating element and one above the broadside surface of the radiating element, the oscillation along the four edges of the radiating element occurring between the radiating element and the ground plane and the oscillation above the broadside surface of the radiating element occurring along the length of the radiating element, there being only one current oscillation of the cavity between the radiating element and ground plane and said current oscillation mode contributes to the five oscillating dipole moments;

j. optimum match for the resonant mode of oscillation being obtained by varying the location of said feed point along the radiating element edge.

2. An antenna as in claim 1 wherein the ground plane conductor extends at least one wavelength beyond each edge of the radiating element to minimize any possible backlobe radiation.

3. An antenna as in claim 1 wherein said radiating element is fed from a coaxial-to-microstrip adapter, the center pin of said adapter extending through said ground plane and dielectric substrate to said radiating element.

4. An antenna as in claim 1 wherein the length of said radiating element is approximately one-fourth wavelength.

5. An antenna as in claim 1 wherein said radiating element is shorted to the ground plane by means of any of rivets and plated-thru holes.

6. An antenna as in claim 1 wherein said radiating element is fed with microstrip transmission line.

7. An antenna as in claim 1 wherein the length of the antenna radiating element is substantially determined by the equation:

$$C = \frac{\left[1.18 \times 10^{10} - F \times 4 \times H \times \sqrt{\epsilon}\right]}{\left[4 \times F \times \sqrt{1 + 0.61 \times (\epsilon - 1) \times (B/H)^{0.1155}}\right]}$$

where

C is the length to be determined

F = the center frequency (Hz)

B = the width of the radiating element, in inches

H = the thickness of the dielectric

E = the dielectric in inches constant of the substrate.

8. An antenna as in claim 3 wherein said radiating element feed point is connected directly to said adapter center pin.

9. An antenna as in claim 3 wherein said radiating element optimum feed point is connected to said adapter center pin by means of microstrip transmission line.

10. An antenna as in claim 1 wherein a plurality of said thin rectangular radiating elements are arrayed on one surface of said dielectric substrate with microstrip transmission line.

* * * * *